United States Patent [19]

Anderson et al.

[11] 4,191,327

[45] Mar. 4, 1980

[54] AUTOMATIC THERMOSTATIC CONTROL FOR A STEAM TRAP RADIATOR

[76] Inventors: Arthur H. Anderson, 790 Boylston St., Boston, Mass. 02199; Thomas E. Murray, 34 South St., Quincy, Mass. 02169

[21] Appl. No.: 850,152

[22] Filed: Nov. 10, 1977

[51] Int. Cl.[2] ..... F24F 11/00

[52] U.S. Cl. ..... 236/42

[58] Field of Search ..... 236/40–42, 236/68 B, 68 C

[56] References Cited

U.S. PATENT DOCUMENTS

| | | | |
|---|---|---|---|
| 890,138 | 6/1908 | Gold | 236/41 |
| 1,583,496 | 5/1926 | Shafer | 236/68 B |
| 1,826,151 | 10/1931 | Persons | 236/42 X |
| 1,951,630 | 3/1934 | Russell et al. | 236/40 |
| 2,870,965 | 1/1959 | Kreuter | 236/68 B |
| 3,386,496 | 6/1968 | O'Connor | 236/68 B X |

OTHER PUBLICATIONS

"Fuel Saving Devices for the Home", *Consumer Reports,* Jan. 1977, pp. 16–18.

*Primary Examiner*—James C. Mitchell

*Attorney, Agent, or Firm*—Kenway & Jenney

[57] ABSTRACT

An auxiliary heating element acts on a steam trap connected to the return outlet of a radiator. A check valve placed between the trap and the radiator prevents dissipation of the steam generated by the auxiliary heating element into the radiator. A thermostat provides automatic control over the operation of the heating element and the radiator.

7 Claims, 4 Drawing Figures

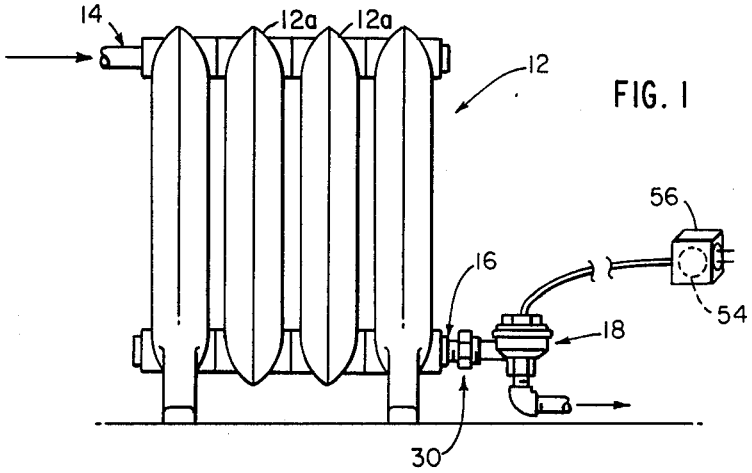
FIG. 1
FIG. 2
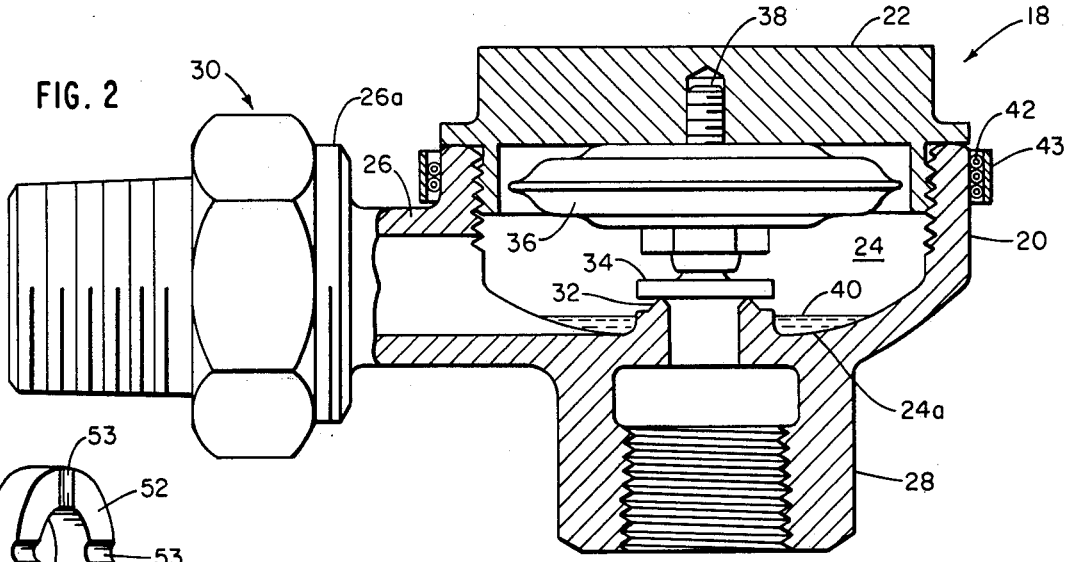
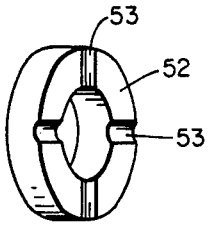
FIG. 4
FIG. 3
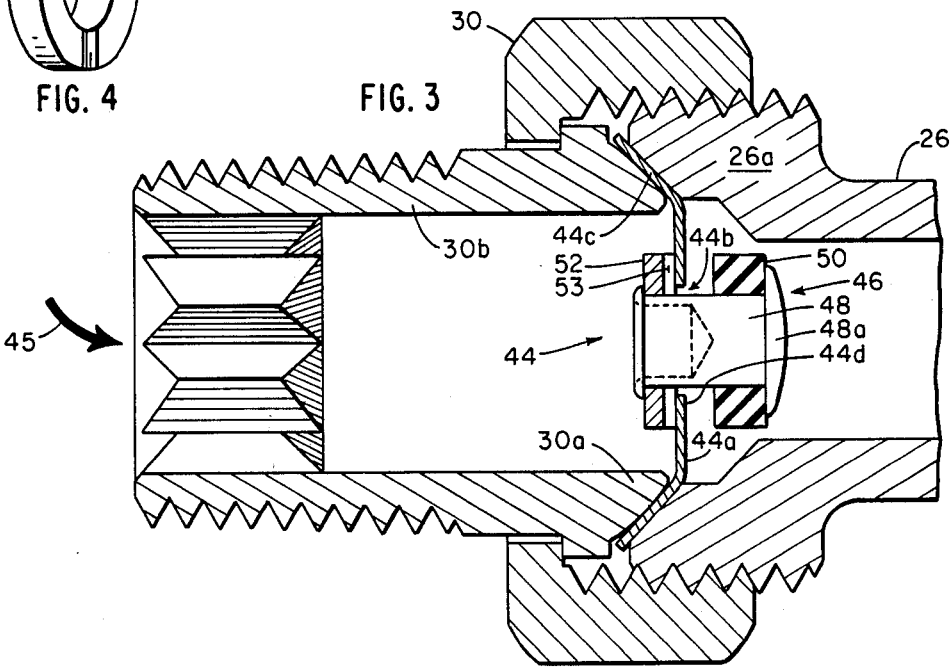

AUTOMATIC THERMOSTATIC CONTROL FOR A STEAM TRAP RADIATOR

BACKGROUND OF THE INVENTION

This invention relates in general to heating systems and in particular to thermostatic controls for steam heating systems.

In conventional two-pipe, vapor heating systems for residential housing and large buildings such as schools, hotels and offices, steam generated in a boiler flows through mains, branches and risers to a number of radiators distributed throughout the building. Each radiator has a thermostatic steam trap connected between its return outlet and a return main for condensed water. A central thermostat or thermostats usually control the release of steam from the boiler. The steam fills the radiator until it reaches the trap where it heats a thin walled metal chamber or bellows secured within the trap. Expansion of the bellows closes a valve within the trap and thereby holds the steam in the radiator to heat the surrounding air and prevents the steam from entering the return lines. As the thermal energy of the steam is radiated into the room, it condenses into water which eventually cools the bellows, opens the trap valve and allows the condensed water to flow into the return main.

While the central thermostat and the conventional thermostatic steam trap thus provide a certain degree of control over the operation of the radiator, they do not provide control for each radiator that is independent of the other radiators. This situation leads to a substantial wastage of heat. Rooms not in use or not frequently in use may be heated the same as rooms in use. Differences in room size, local heat loss due for example to poorer insulation or an open window can also result in uneven, wasteful heating. Also during mild weather, the typically "sluggish" response of the steam radiator to fluctuations in the ambient temperature cause overheating. These problems of heat regulation and the fuel waste are particularly acute in large buildings.

A well-known arrangement for providing individual controls is a manual input supply valve at the radiator. Such valves however require at least periodic attention and are often difficult to adjust accurately for a desired heat output. As a result, they often function simply as on-off devices. Self controlled supply valves are available which to a large extent overcome these problems, but they are relatively expensive, particularly since installation requires changes in the piping. Other known techniques such as individual room thermostats, compressed air thermostats on individual radiators, and motorized valves on the risers controlled by one or more "central" thermostats have obvious cost disadvantages particularly in terms of installation, whether initial or modification of an existing steam heat system. For the motorized valves, a steam fitter must make changes in the piping to install the valves. Conventional thermostats require the services of an electrician. Moreover, these regulators tend to be slow in responding to temperature variations and/or are costly to maintain and adjust.

Another approach to regulation of a heating system has been to influence the thermostat. For example, U.S. Pat. No. 3,386,496 to O'Connor describes two heaters placed near the thermostat. The result is that the ambient room temperature can be held at, above or below a set temperature depending on whether one, none or both of the heaters, respectively, are in operation. U.S. Pat. No. 1,583,496 to Shafer describes another well-known approach, control of the thermostat with a clock to vary the heat output with the time of day. In both the O'Connor and Shafer systems, however, there is no direct, independent regulation of the radiators unless each radiator has an associated thermostat and radiator control as well as the heater or clock device.

It is a principal object of the present invention to provide an automatic thermal control system for an individual steam trap radiator, that has a low cost, can be easily installed with a minimum of skill and requires no changes in piping or rewiring.

Yet another object of this invention is to provide individual thermostatic control for a steam trap radiator that is automatically responsive to the ambient room temperature.

A still further object of this invention is to provide a low cost device for matching the heat output of a steam heat system to the varying heating requirements of different regions of a building and thereby achieve substantial fuel savings.

SUMMARY OF THE INVENTION

An automatic thermostatic control for an individual radiator has a heating element, preferably a length of insulated, high-resistance heating wire, positioned to heat a steam trap connected to the outlet of a steam radiator. The heating element closes the trap valve by direct heating and by boiling the residual water usually present in the trap. A check valve installed between the trap and the radiator blocks any substantial flow of the residual water steam from the trap into the radiator. In a preferred form, the check valve has a flanged mounting apron that is secured in a union connecting the trap to the radiator. For automatic control in response to changes in the ambient room temperature, a thermostat is connected in series with the heating wires. An annular clamp preferably secures the heating wire around the housing of the steam trap to fix its location and promote an efficient heat transfer to the trap.

These and other objects and features of the invention will be more fully understood from the following detailed description which should be read in light of the accompanying drawings.

BRIEF DESCRIPTION OF THE DRAWINGS

FIG. 1 is a view in front elevation of an automatic thermostatically controlled trap radiator incorporating the invention;

FIG. 2 is an enlarged view partially in section of the steam trap and heating coil shown in FIG. 1;

FIG. 3 is a further enlarged sectional view corresponding to FIGS. 1 and 2 illustrating a check valve according to the invention; and FIG. 4 is a perspective view of the check valve spacer washer shown in FIG. 3.

DETAILED DESCRIPTION OF THE PREFERRED EMBODIMENTS

FIG. 1 shows a conventional steam radiator 12 for a two-pipe vapor system. The radiator has a steam inlet 14 and a return outlet 16. Steam from a boiler (not shown) is carried by mains, branches and risers (not shown) to a number of radiators 12 distributed throughout the structure being heated. Typically each room of the structure has at least one associated radiator 12.

When a central thermostat or thermostats (not shown) activate a release of steam from the boiler, the steam flows into the inlet 14 of each radiator, through each section 12*a* of the radiator, and through the outlet 16 to a steam trap 18.

The trap 18 consists of a body 20 which together with a cover 22 threaded into the body defines a central cavity 24. An inlet conduit 26 extends laterally from the cavity 24 and a drain conduit 28 extends downwardly from the center of the cavity 24. The inlet 26 has an exterior thread 26*a* that is connected to the return outlet 16 of the radiator 12 by a union 30. The trap drain 28 directs fluids, normally condensed water and air, from the trap to a return main that carries the condensed water back to the boiler.

A valve seat 32 is formed on the trap body adjacent the drain 28. A valve member 34, positioned directly over the seat 32, is pivotally connected to a conventional thin-walled metal bellows 36. A screw 38 secured to the bellows 36 threads into the cover. It should be noted that the valve seat is raised with respect to the adjacent portion of the body 20 to form an annular well 24*a* that usually holds a small amount of residual condensed water 40 in the trap. The bellows 36 and valve member 34 are designed and positioned so that the valve member is spaced from the seat 32 when the bellows is relatively cool ("open" position) and firmly engages the seat when the bellows expands in the presence of steam ("closed" position).

A principal feature of the present invention is an electrical heating element 42, preferably an insulated nichrome "cord" such as the product sold under the trade designation "Rope Heater" by Hot Watt, Inc. of Danvers, Massachusetts. The cord 42 is wound around the trap body so that the resistance heat of a current in the cord heats the bellows 36 directly and indirectly through steam generated by boiling the residual water 20. With the standard steam trap 18 shown, this requires an electrical energy input of approximately 40 watts which is provided by two turns of the nichrome cord 42 placed around the trap body 20 just below the cover. A clamp 43 such as an automobile hose clamp surrounds and secures the cord 42 in this position.

Another principal feature of the invention is a check valve 44 (FIGS. 3 and 4) positioned in a fluid flow path 45 between the radiator outlet 16 and the trap 18. The valve 44 has plate portion 44*a* that extends transversely across the path 45 except for a central opening 44*b*. An apron 44*c* surrounds the plate 44*a* and is secured in a fluid tight grip by the end 26*a* of the trap inlet conduit and the opposed end 30*a* of the union coupling 30*b*.

The check valve 44 has a valve member 46 formed of a rivet 48 that slides axially with a clearance in the opening 44*b*. The rivet has a head 48*a* on the side of the valve plate 44*a* adjacent the trap. A washer 50 mounted on the rivet under the head 48*a* blocks the opening 44*b* when the rivet is in an extreme left position. A portion 44*d* of the plate 44*a* adjacent the opening 44*b* thus serves as a valve seat. On the opposite side of the plate 44*a*, the rivet 48 carries a spacer washer 52 (FIG. 4) that has four radial channels 53 formed in its surface facing the plate 44*a*. The spacing between the spacer washer 52 and the washer 50 defines the maximum travel of the entire valve member 46, that is, the rivet 48 and the washer 50.

While the heating cord 42 can be connected directly to a standard electrical outlet, it is preferably connected in series with a thermostat 54 that senses the ambient room temperature. The heating element then operates under the control of the thermostat and in response to the difference between the ambient room temperature and a preselected set temperature. The thermostat 54 can be a conventional temperature responsive unit or a timer thermostat that changes the operating characteristics of the radiator 12 depending on the time of day. The thermostat 54 is preferably mounted in a housing 56 that plugs directly into an electrical outlet.

The thermostat 54 provides automatic control over the operation of the trap 18 and hence the radiator 12. In a typically operating cycle, when the room temperature is above the set temperature of the thermostat 54 (e.g. 60° F.), current flows in the heating cord 42 and no steam is present in the radiator 12. There is usually air in the radiator and trap and some residual condensed water from previous heat cycles. The current flow in the cord 42 heats the trap 18 and boils the residual water 40. The heat thus generated expands the bellows and closes the valve trap. Also, the steam develops a fluid pressure on the "trap" side of the check valve 44 that is greater than the fluid pressure on the "radiator" side where no steam is present. This pressure differential moves the valve member 46 toward the radiator causing the washer 50 to engage the valve seat 44*d*. In this position, the check valve 44 blocks a fluid flow from the trap to the radiator. Without the check valve, the steam generated in the trap would heat the radiator and would not reliably heat the bellows to close the trap.

As the temperature in the building generally falls to the set temperature of the central thermostat (e.g. 72° F.), steam is released from the boiler to the risers and associated radiators in the system. The radiators not incorporating this invention will have their trap open so that the incoming steam will fill the radiator and displace the air and condensed water through the trap to the return main. When the steam reaches the trap, it will close thereby holding the radiator full of steam. In contrast, in the radiator 12 incorporating the invention and like radiators, the trap 18 is closed before the steam arrives. The residual air is therefore not readily displaced from the radiator 12 and it receives less steam than a comparable radiator that does not incorporate this invention. Because of the relatively low steam pressure of the heating system, typically fifteen psi, the steam pressure generated in the trap by the heating element 42 will usually hold the check valve 44 closed during the entire period when steam is present in the radiator.

When the temperature falls below the set temperature of the thermostat 54, current flow in the heating cord 42 will terminate. As the trap 18 cools, the bellows 36 contracts and the valve opens. Also, the pressure on the "trap" side of the check valve 44 decreases. The condensed water in the radiator 12 can then open the check valve 44 and flow into the trap 18 through the channels 54 in the spacer washer 52. Of course, the room temperature can fall below the set temperature of the thermostat at different times of the operating cycle of the boiler under the control the central thermostat. Therefore, the trap 18 can be fully open, closed, or about to open or close when the steam enters the radiator. In general, the trap will be closed or open depending on whether the room temperature is above or below, respectively, the set temperature of the thermostat 54.

It should also be noted that the invention is readily installed on a conventional steam trap radiator with no changes in the piping such as the installation of motorized valves and without the need for rewiring such as the installation of conventional wall thermostats in each room. Installation of the heating element is accomplished by wrapping the heating cord 42 around the steam trap, securing it with the clamp 43 and plugging the control box housing 56, which contains the thermostat 54, into a wall outlet. The check valve is installed by uncoupling the union 30 connecting the trap to the radiator, placing the valve 44 in the union, and recoupling the union thereby securing the valve as shown in FIG. 3.

Although the invention has been described with reference to a thermostatically controlled electrical heating element and a specific design of check valve, it will be understood by those skilled in the art that alternatives are available. For example, the trap can be heated by a gas or chemical heating element. Also, the check valve structure and location can be varied provided that it substantially blocks the flow of steam generated by the heating element acting on the trap. For example, it is contemplated that the spacer washer 52 can be replaced with an angled washer with no channels 53, that is, one that is "bent" about its diameter.

These and other variations and modifications will occur to those skilled in the art from the foregoing detailed description and the accompanying drawings. Such variations and modifications are intended to fall within the scope of the appended claims.

What is claimed and desired to be secured by Letters Patent is:

1. A control system for a steam radiator having an inlet and an outlet and having a steam trap with a thermostatic valve member in fluid communication with the outlet, said trap having means for holding a quantity of residual water within the trap, comprising, in combination, auxiliary means mounted on said trap for heating said trap and said residual water to close said thermostatic valve member and block a fluid flow from the radiator through said trap, said residual water heated by said auxiliary means generating a fluid pressure within said trap, and second valve means in the fluid flow path between the radiator and said trap, said second valve means being operable to pass a fluid flow from the radiator to said trap and to block a reverse fluid flow when said fluid pressure in said trap generated by said auxiliary heating means exceeds the fluid pressure at the return outlet of the radiator.

2. A control system according to claim 1 further comprising thermostat means that controls the operation of said auxiliary heating means in response to the ambient air temperature.

3. A control according to claim 2 wherein said auxiliary heating means comprises an electrical resistance heating element.

4. A control system for a steam radiator having an inlet and an outlet and having a steam trap with a thermostatic valve member in fluid communication with the outlet, said trap having means for holding a quantity of residual water within the trap, comprising in combination, an electrical resistance heating element mounted on said trap that heats said trap to close said thermostatic valve member and block a fluid flow from the radiator through said trap, said residual water heated by said heating element generating a fluid pressure within said trap, a check valve located in a fluid flow path between the radiator and said trap and operable to pass a fluid flow from the radiator to said trap and to block a reverse fluid flow when said fluid pressure in said trap generated by said heating element exceeds the fluid pressure at the return outlet of the radiator, and thermostat means for controlling the flow of electrical current to said heating element in response to the ambient air temperature.

5. A control system according to claim 4 wherein said electrical resistance heating element is a flexible, insulated cord.

6. A control system according to claim 5 further comprising means for securing said heating cord around the exterior of said steam trap.

7. A control system according to claim 4 wherein said check valve includes a valve seat, means for supporting said valve seat in said fluid flow path, a valve member that closes on said seat to block said reverse flow and spacer means carried on said valve member to allow said fluid flow from the radiator to said trap.

* * * * *